US011628995B1

(12) United States Patent
Lai

(10) Patent No.: US 11,628,995 B1
(45) Date of Patent: Apr. 18, 2023

(54) HANG TAG FOR SOCKET

(71) Applicant: Yi-Hsuan Lai, Taichung (TW)

(72) Inventor: Yi-Hsuan Lai, Taichung (TW)

( * ) Notice: Subject to any disclaimer, the term of this patent is extended or adjusted under 35 U.S.C. 154(b) by 0 days.

(21) Appl. No.: 17/724,669

(22) Filed: Apr. 20, 2022

(51) Int. Cl.
*B65D 85/28* (2006.01)
*B65D 73/00* (2006.01)
*B25H 3/00* (2006.01)

(52) U.S. Cl.
CPC ..... *B65D 73/0064* (2013.01); *B25H 3/003* (2013.01)

(58) Field of Classification Search
CPC .... B65D 5/4208; B65D 73/0064; B25B 13/06
USPC ..... 206/349, 372, 376, 378, 806; 211/70.6
See application file for complete search history.

(56) References Cited

U.S. PATENT DOCUMENTS 5,855,284 A * 1/1999 Dembicks ..... B25H 3/003 211/89.01
6,032,797 A * 3/2000 Kao ..... B25H 3/04 206/349
6,250,466 B1 * 6/2001 Ernst ..... B25H 3/003 206/378
6,450,338 B1 * 9/2002 Chen ..... B25H 3/003 206/378
6,672,555 B2 * 1/2004 Chang ..... A47F 5/0006 206/378
8,448,787 B1 * 5/2013 Chang ..... B65D 73/0064 206/378
8,857,777 B2 * 10/2014 Chang ..... B65D 73/0064 248/224.7
2005/0126943 A1 * 6/2005 Liu ..... B65D 73/0064 206/349
2007/0102381 A1 * 5/2007 Nguy ..... B25H 3/025 206/821
2007/0193313 A1 * 8/2007 Tsai ..... B65D 73/0064 70/57.1

* cited by examiner

*Primary Examiner* — Luan K Bui

(57) ABSTRACT

A hang tag includes a hanging card including a label adhering member between a first enhancement member and a second enhancement member, the first enhancement member including a through hole, and the second enhancement member including two extending seats projecting out of front and rear ends respectively; two opposite resilient members extending downward from the extending seats, each resilient member including a first inclined section having one end integrally formed with bottoms of the extending seats, and a second inclined section having one end integrally formed with the other end of the first inclined section; two pressing members each formed at a joining portion of the first inclined section and the second inclined section; and a snapping member including two snapping sections on two sides respectively and an interconnection section interconnecting the snapping sections. The snapping member is configured to insert into a socket.

10 Claims, 5 Drawing Sheets

HANG TAG FOR SOCKET

FIELD OF THE INVENTION

The invention relates to hang tags and more particularly to a hang tag adapted to releasably secure to a socket.

BACKGROUND OF THE INVENTION

Conventionally, a hang tag is adapted to releasably secure to a product or tool (e.g., socket) so that a person can conveniently, quickly remove the socket.

However, the conventional hang tag is disadvantageous due to poor fastening capability and low structural strength. It is often that a portion of the hang tag is jammed in the socket. Thus, it is difficult of removing the hang tag.

Thus, the need for improvement still exists.

SUMMARY OF THE INVENTION

It is therefore one object of the invention to provide a hang tag comprising a hanging card including a first enhancement member, a second enhancement member, and a label adhering member formed between the first enhancement member and the second enhancement member wherein the first enhancement member is disposed on a top of the label adhering member and includes a through hole, and the second enhancement member is disposed on a bottom of the label adhering member and includes two extending seats projecting out of front and rear ends respectively; two opposite resilient members extending downward from the extending seats, each of the resilient members including a first inclined section having one end integrally formed with bottoms of the extending seats and extending outward along transverse axes of the extending seats, and a second inclined section having one end integrally formed with the other end of the first inclined section and extending inward along the transverse axes of the extending seats; two pressing members each integrally formed at a joining portion of the first inclined section and the second inclined section of the resilient member; and a snapping member including two snapping sections on two sides respectively and an interconnection section interconnecting the snapping sections wherein a top end of the snapping section is integrally formed with the other end of the second inclined section, the snapping section is inclined and extends inward along the transverse axes of the extending seats, and a bottom end of the snapping section is integrally formed with either end of the interconnection section.

The invention has the following advantages and benefits in comparison with the conventional art:

Increased structural strength. The label adhering member is formed between the first enhancement member and the second enhancement member so that structural strength of the label adhering member can be increased.

Increased stability. The second enhancement member includes the two extending seats projecting out of front and rear ends respectively so that the partial insertion of the hang tag into the socket is secured. Otherwise, the partial insertion of the hang tag into the socket may be loosened.

A pressing member on either side. The pressing members are provided on two sides of the hang tag respectively and the resilient members are also provided on two sides of the hang tag respectively. A pressing of the pressing members flexibly deforms the resilient members and move same toward each other. And in turn, both the snapping sections are flexibly deformed to move toward each other. This facilitates the insertion of the snapping member into the socket or disengagement of the snapping member from the socket.

Facilitated insertion of the snapping member into the socket. The snapping section is inclined and extends inward along the transverse axes of the extending seats so that the fastening of the snapping member and the axial through hole of the socket is made easy.

Prevention of excessive insertion of the snapping member into the socket. The limit members are formed on front and rear ends of a joining portion of the second inclined section and the snapping section respectively. The insertion of the snapping member into the axial through hole of the socket is stopped when the limit members contact a top of the socket. As a result, depth of the snapping member inserted into the socket can be defined.

Slip-resistant arrangement. The first enhancement member includes the two lips provided on front and rear ends respectively and disposed above the through hole. The lip outward extends along a transverse axis of the hanging card. The provision of the lips allows a person to easily take the hang tag by holding the lips. Otherwise, the hang tag may be slipped when being held by the hand.

The above and other objects, features and advantages of the invention will become apparent from the following detailed description taken with the accompanying drawings.

DETAILED DESCRIPTION OF THE INVENTION

Figure 1:
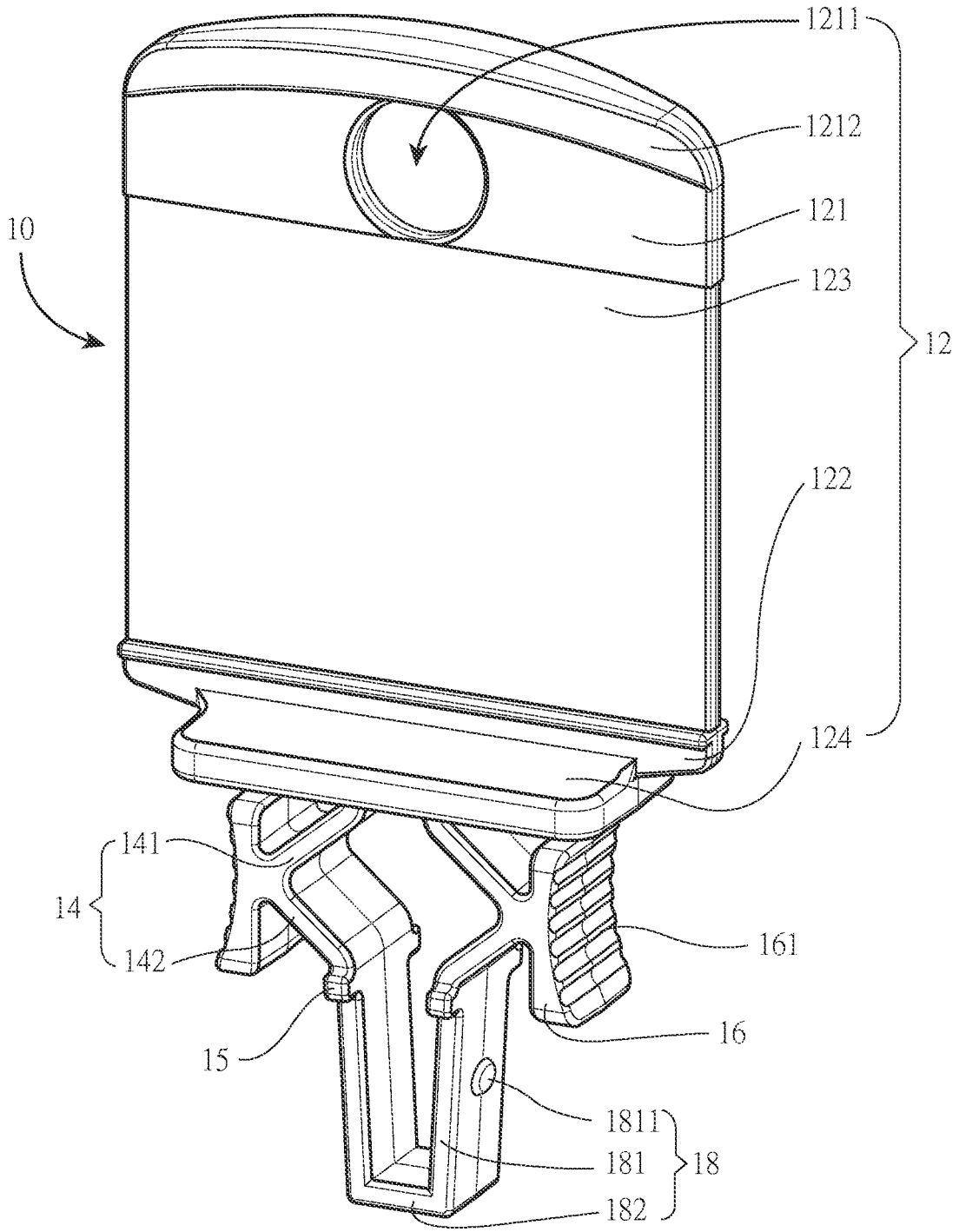
FIG. 1 is a perspective view of a hang tag according to the invention.

Referring to FIGS. 1 to 6, a hang tag 10 in accordance with the invention comprises the following components as discussed in detail below.

A hanging card 12 includes a first enhancement member 121, a second enhancement member 122 and a label adhering member 123 formed between the first enhancement member 121 and the second enhancement member 122 so that structural strength of the label adhering member 123 can be increased. The first enhancement member 121 is provided on a top of the label adhering member 123 and includes a through hole 121. The second enhancement member 122 is provided on a bottom of the label adhering member 123 and includes two extending seats 124 projecting out of front and rear ends respectively. In the invention, thickness of the first enhancement member 121 is greater than that of the label adhering member 123 and thickness of the second enhancement member 122 is greater than that of the label adhering member 123.

Two opposite resilient members 14 are extended downward from the extending seats 124. The resilient member 14 includes a first inclined section 141 having one end integrally formed with bottoms of the extending seats 124 and extending outward along transverse axes of the extending seats 124, and a second inclined section 142 having one end integrally formed with the other end of the first inclined section 141 and extending inward along the transverse axes of the extending seats 124.

Two pressing members 16 each form at a joining portion of the first inclined section 141 and the second inclined section 142 of the resilient member 14. In the invention, the pressing member 16 and the resilient member 14 of the left side is shaped as a "K" when viewing from the front end, and the pressing member 16 and the resilient member 14 of the right side is shaped as a "K" when viewing from the rear end (see FIG. 1). The pressing member 16 includes a knurled portion 161 on an outer surface.

Figure 4:
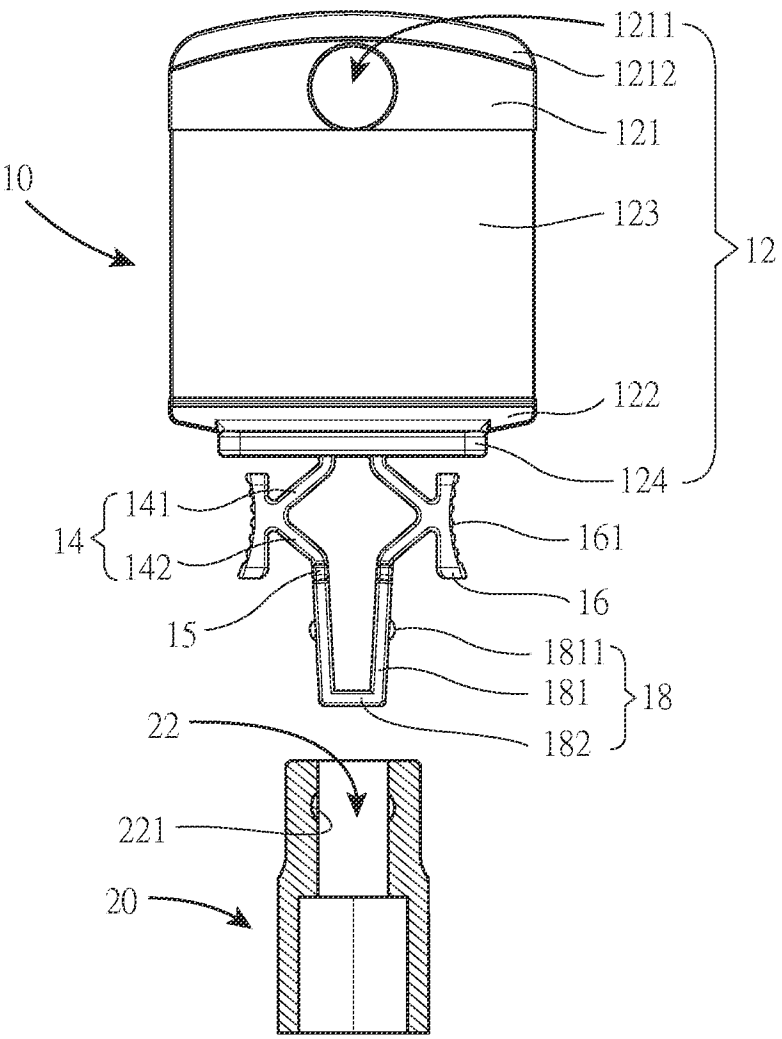
FIG. 4 is another longitudinal sectional view of the hang tag and the socket separated.

A snapping member 18 is shaped as a "U" when viewing from the front end or the rear end (see FIG. 4). The snapping member 18 includes two snapping sections 181 on two sides respectively and an interconnection section 182 interconnecting the snapping sections 181. A top end of the snapping section 181 is integrally formed with the other end of the second inclined section 142. The snapping section 181 includes a projection 1811 on an outer surface. The snapping section 181 is inclined and extends inward along the transverse axes of the extending seats 124. A bottom end of the snapping section 181 is integrally formed with either end of the interconnection section 182.

Figure 2:
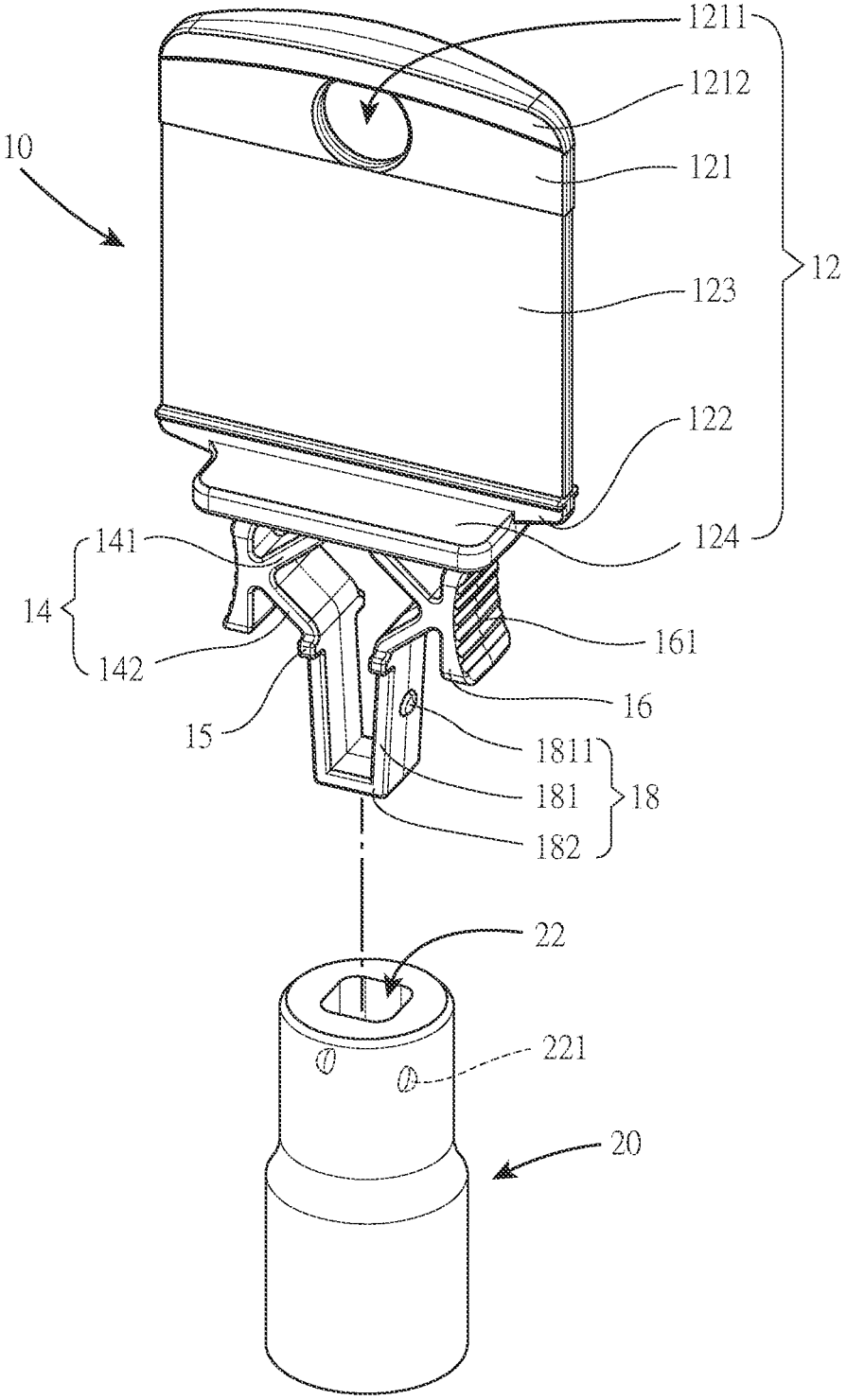
FIG. 2 is a perspective view of the hang tag to be secured to a socket.

As shown in FIGS. 2 and 4 specifically, the hang tag 10 and a socket 20 are not secured together. The socket 20 includes an axial through hole 22 having a rectangular or square section. Two wells 221 are formed on surfaces of two sides of the axial through hole 22. The projections 1811 are complementarily disposed in the wells 221 respectively when the hang tag 10 and the socket 20 secured together.

Figure 3:
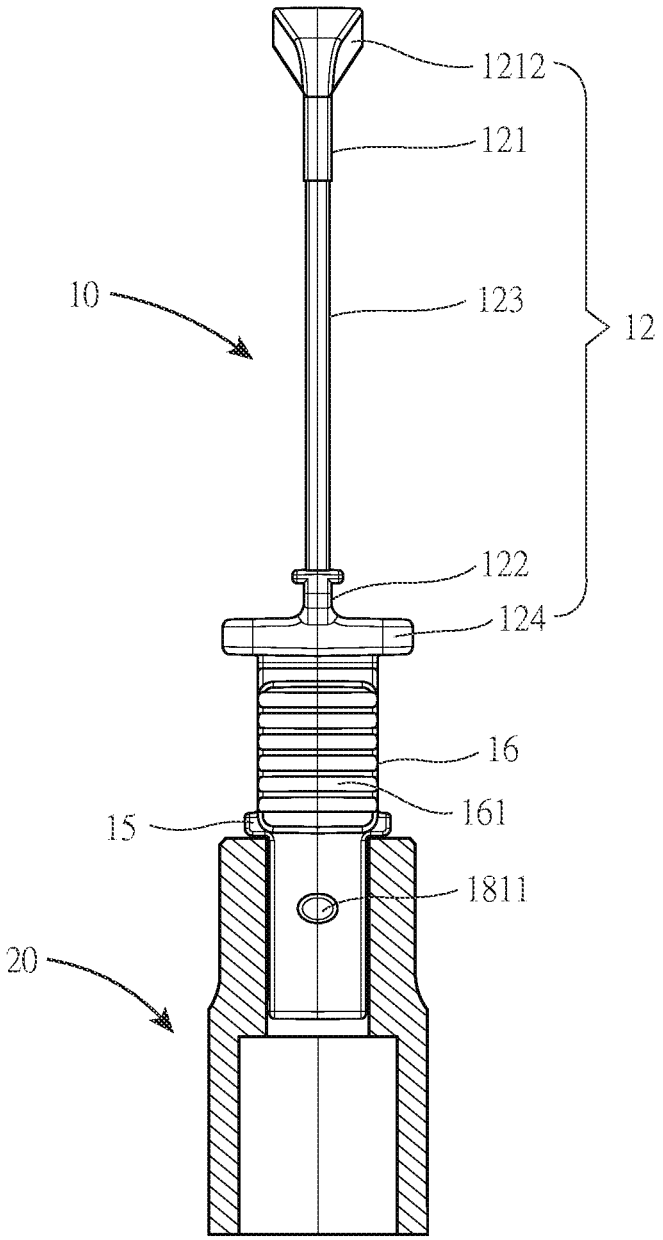
FIG. 3 is a longitudinal sectional view of the hang tag and the socket secured together.

As shown in FIG. 3 specifically, it is a longitudinal sectional view of the hang tag 10 and the socket 20 secured together. The first enhancement member 121 includes two lips 1212 formed on front and rear ends respectively and disposed above the through hole 1211. The lip 1212 outward extends along a transverse axis of the hanging card 12. The provision of the lips 1212 allows a person to easily take the hang tag 10 by holding the lips 1212. Otherwise, the hang tag 10 may be slipped when being held by the hand.

As shown in FIGS. 2 and 3 specifically, two limit members 15 are formed on front and rear ends of a joining portion of the second inclined section 142 and the snapping section 181 respectively. The insertion of the snapping member 18 into the axial through hole 22 is stopped when the limit members 15 contact a top of the socket 20. As a result, depth of the snapping member 18 inserted into the socket 20 can be defined.

It is noted that the label adhering member 123 is provided between the first enhancement member 121 and the second enhancement member 122 so that structural strength of the label adhering member 123 can be increased. The second enhancement member 122 includes the two extending seats 124 projecting out of front and rear ends respectively. Width of a joining surface of the first inclined section 141, the second inclined section 142 and the pressing member 16 is greater than width of the hanging card 12 but less than width of the extending seat 124. As shown in FIG. 3 specifically, the widths of the pressing member 16, the first inclined section 141 and the second inclined section 142 each are equal to width of the joining surface so that the partial insertion of the hang tag 10 into the socket 20 is secured. Otherwise, the partial insertion of the hang tag 10 into the socket 20 may be loosened.

Figure 5:
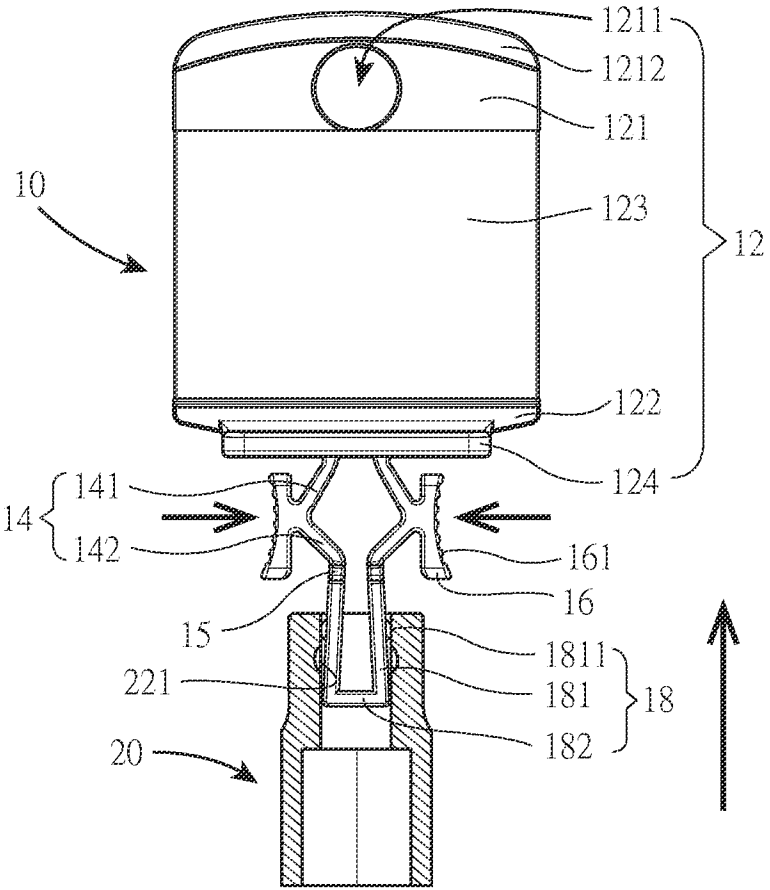
FIG. 5 is a view similar to FIG. 4 showing the hang tag and the socket to be secured together by pressing the resilient members toward each other and pushing the socket onto the snapping member.
Figure 6:
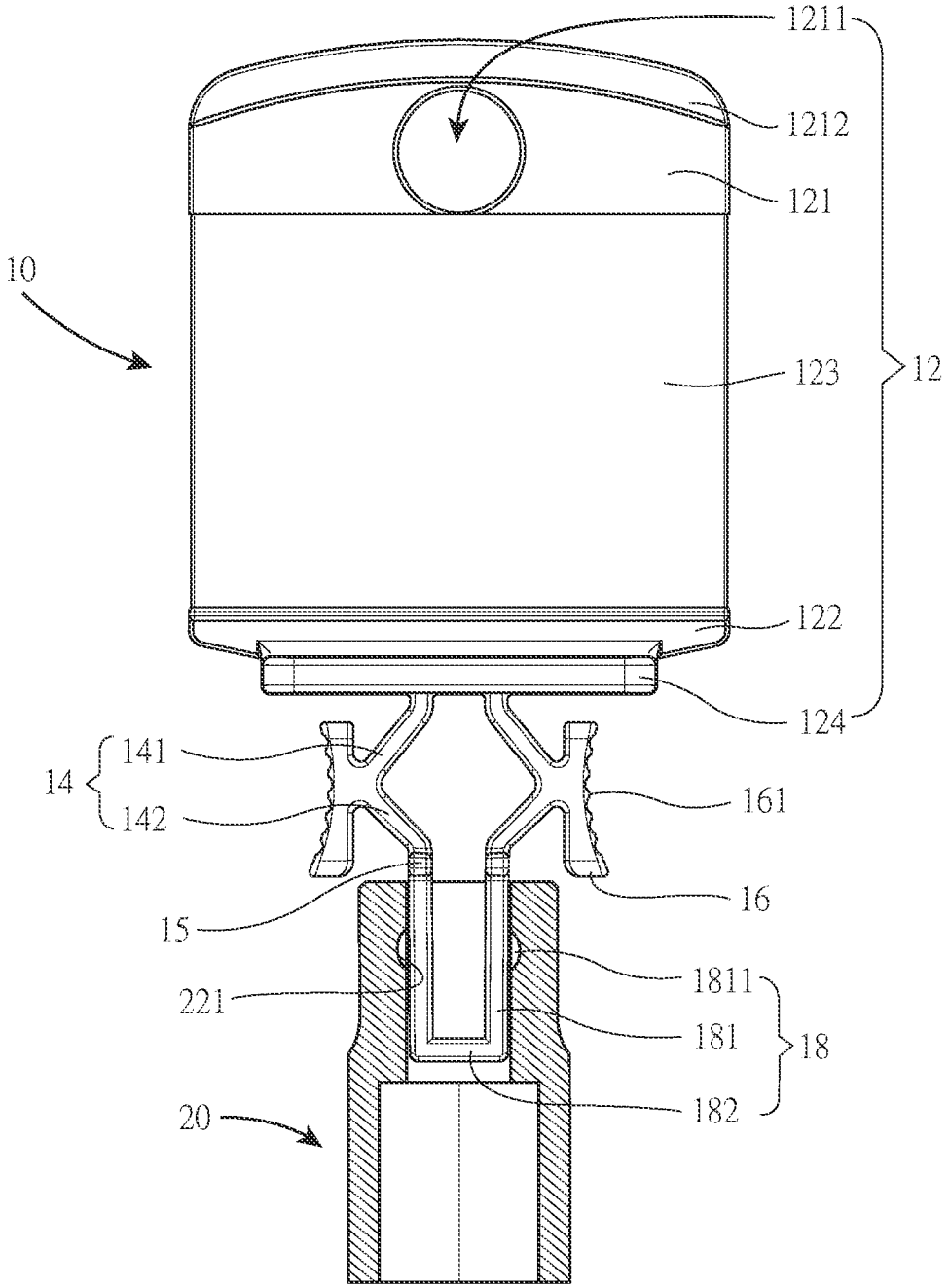
FIG. 6 is a view similar to FIG. 5 showing the hang tag and the socket secured together.

As shown in FIGS. 5 and 6 specifically in which FIG. 5 shows the hang tag 10 and the socket 20 to be secured together by pressing the resilient members 14 toward each other and pushing the socket 20 onto the snapping member 18, and FIG. 6 shows the hang tag 10 and the socket 20 secured together. In detail, for using the hang tag 10, a person may press the pressing members 16 to move the resilient members 14 toward each other. And in turn, both the first inclined sections 141 and the second inclined sections 142 are flexibly deformed and both the snapping sections 181 are also flexibly deformed to move toward each other. This facilitates the insertion of the snapping member 18 into the axial through hole 22 of the socket 20. The projections 1811 are complementarily disposed in the wells 221 respectively when the hang tag 10 and the socket 20 secured together.

While the invention has been described in terms of preferred embodiments, those skilled in the art will recognize that the invention can be practiced with modifications within the spirit and scope of the appended claims.

What is claimed is:

1. A hang tag, comprising:

a hanging card including a first enhancement member, a second enhancement member, and a label adhering member formed between the first enhancement member and the second enhancement member wherein the first enhancement member is disposed on a top of the label adhering member and includes a through hole, and the second enhancement member is disposed on a bottom of the label adhering member and includes two extending seats projecting out of front and rear ends respectively;

two opposite resilient members extending downward from the extending seats, each of the resilient members including a first inclined section having one end integrally formed with bottoms of the extending seats and extending outward along transverse axes of the extending seats, and a second inclined section having one end integrally formed with the other end of the first inclined section and extending inward along the transverse axes of the extending seats;

two pressing members each formed at a joining portion of the first inclined section and the second inclined section of the resilient member; and a snapping member including two snapping sections on two sides respectively and an interconnection section interconnecting the snapping sections wherein a top end of the snapping section is integrally formed with the other end of the second inclined section, the snapping section is inclined and extends inward along the transverse axes of the extending seats, and a bottom end of the snapping section is integrally formed with either end of the interconnection section.

2. The hang tag of claim 1, further comprising a socket including an axial through hole.

3. The hang tag of claim 1, wherein the snapping section includes a projection on an outer surface.

4. The hang tag of claim 1, wherein thickness of the first enhancement member is greater than that of the label adhering member and thickness of the second enhancement member is greater than that of the label adhering member.

5. The hang tag of claim 1, further comprising two limit members formed on front and rear ends of a joining portion of the second inclined section and the snapping section respectively.

6. The hang tag of claim 1, wherein width of a joining surface of the first inclined section, the second inclined section, and the pressing member is greater than width of the hanging card but less than width of the extending seat, the widths of the pressing member, the first inclined section, and the second inclined section each are equal to width of the joining surface.

7. The hang tag of claim 1, wherein the snapping member is shaped as a "U" when viewing from a front end or a rear end.

8. The hang tag of claim 1, wherein the pressing member and the resilient member of the left side is shaped as a "K" when viewing from a front end, and the pressing member and the resilient member of the right side is shaped as a "K" when viewing from a rear end.

9. The hang tag of claim 1, wherein the pressing member includes a knurled portion on an outer surface.

10. The hang tag of claim 1, wherein the first enhancement member includes two lips formed on front and rear ends respectively and disposed above the through hole, the lip outward extending along a transverse axis of the hanging card.

* * * * *